US006960112B2

(12) United States Patent
Helmlinger et al.

(10) Patent No.: US 6,960,112 B2
(45) Date of Patent: Nov. 1, 2005

(54) AIRFOIL BLADE WITH CUSHIONED EDGE FOR POWERED TOY AIRCRAFT

(75) Inventors: David Vincent Helmlinger, Mount Laurel, NJ (US); Gregory Gilbert Garneau, Berlin, NJ (US); Lee Chun Wah, Hong Kong (HK); Chung Zhi Jie, Guang Zhou (CN)

(73) Assignee: Mattel, Inc., El Segundo, CA (US)

( * ) Notice: Subject to any disclaimer, the term of this patent is extended or adjusted under 35 U.S.C. 154(b) by 4 days.

(21) Appl. No.: 10/778,369

(22) Filed: Feb. 13, 2004

(65) Prior Publication Data

US 2005/0037685 A1 Feb. 17, 2005

Related U.S. Application Data

(60) Provisional application No. 60/494,594, filed on Aug. 12, 2003.

(51) Int. Cl.[7] ..... A63H 27/127
(52) U.S. Cl. ..... 446/36
(58) Field of Search ..... 416/63, 87–89, 416/214, 207, 224, 229, 240, 241; 446/36–38, 446/57, 58, 66, 232; 244/7 A, 17.11, 39, 244/17, 11

(56) References Cited

U.S. PATENT DOCUMENTS

| | | | | |
|---|---|---|---|---|
| 1,332,175 A | | 2/1920 | Hashimoto | |
| 2,432,774 A | | 12/1947 | Lufestec | |
| 3,182,422 A | | 5/1965 | Ryan | |
| 3,955,817 A | | 5/1976 | Davis | |
| 4,251,189 A | * | 2/1981 | Zinsser et al. | 416/240 |
| 4,895,491 A | | 1/1990 | Cross | |
| 5,044,884 A | | 9/1991 | Thibault | |
| 5,163,814 A | | 11/1992 | Hutter | |
| 5,628,620 A | * | 5/1997 | Arlton | 416/114 |
| 5,782,607 A | * | 7/1998 | Smith et al. | 416/224 |
| 5,851,106 A | | 12/1998 | Steiner | |
| 5,993,158 A | | 11/1999 | Young | |
| 6,106,235 A | * | 8/2000 | Tettenborn et al. | 416/229 R |
| 6,550,715 B1 | | 4/2003 | Reynolds | |
| 2002/0142699 A1 | | 10/2002 | Davis | |
| 2003/0085320 A1 | | 5/2003 | Rehkemper | |
| 2003/0111575 A1 | | 6/2003 | Rehkemper | |

* cited by examiner

*Primary Examiner*—Derris H. Banks
*Assistant Examiner*—Faye Francis
(74) *Attorney, Agent, or Firm*—Akin Gump Strauss Hauer & Feld, LLP

(57) ABSTRACT

An airfoil blade in a powered toy aircraft has a body with a cushioned edge. The body has a first end adjoining a hub, a second opposing end, a forward edge, and an opposing trailing edge. The cushioned leading edge is attached mechanically to the body and extends along the forward edge so as to form a cushioned leading edge of the blade or along the second end to form a cushioned blade tip or both. The body is formed from a first resiliently flexible polymer plastic material. The cushioned edge is formed from a second noticeably softer material such as an elastomer.

22 Claims, 3 Drawing Sheets

AIRFOIL BLADE WITH CUSHIONED EDGE FOR POWERED TOY AIRCRAFT

CROSS-REFERENCE TO RELATED APPLICATIONS

This application claims benefit of U.S. Provisional Patent Application 60/494,594, entitled "Blade with Cushioned Leading Edge for Toy Aircraft", filed Aug. 12, 2003.

BACKGROUND OF THE INVENTION

This invention generally relates to powered toy aircraft and, more particularly, to airfoil blades used in such toy aircraft.

In general, powered toy aircraft have used rigid or substantially rigid airfoil blades spinning at speeds to enable take off and flight of the aircraft. Most Western now require guards on the blades of such toys. Some manufacturers place various types of bumpers that extend out of and around or in front of the leading edge of the blade. These bumpers generally take the form of a deflectable rounded member in front of the leading edge of the blade that acts absorb and diffuse the impact.

There are two major drawbacks associated with the prior-art guards. First, the presence of the guards takes away from the authenticate look of the blades. Second, the guards can break. Once broken, the guards can no longer perform their protective function. Moreover, any jagged edges that may exist after breaking could increase the potential for injury should a user be struck.

The airfoil blade of the present invention seeks to overcome these and other deficiencies of the prior-art blades.

BRIEF SUMMARY OF THE INVENTION

Briefly stated, the present invention is, in a powered toy aircraft, an airfoil blade improvement comprising a body and a cushioned edge. The body has a first end adjoining a hub, a second opposing end, a forward edge, and an opposing trailing edge. The cushioned edge is attached to the body and extends at least along the forward edge so as to form a leading edge of the blade. The body is formed from a first polymeric material having a first rigidity and the cushioned edge is formed from a second material having a second rigidity lower than the first rigidity.

In another aspect, the present invention is, in a powered toy aircraft, an airfoil blade improvement comprising a body and a cushioned edge. The body has a first end adjoining a hub, a second opposing end, a forward edge, and an opposing trailing edge. The cushioned edge is attached to the body and extends at least along the second opposing end so as to form a cushioned tip of the blade. The body is formed from a first polymeric material having a first rigidity and the cushioned edge is formed from a second material having a second rigidity lower than the first rigidity.

BRIEF DESCRIPTION OF THE SEVERAL VIEWS OF THE DRAWINGS

The foregoing summary, as well as the following detailed description of the preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
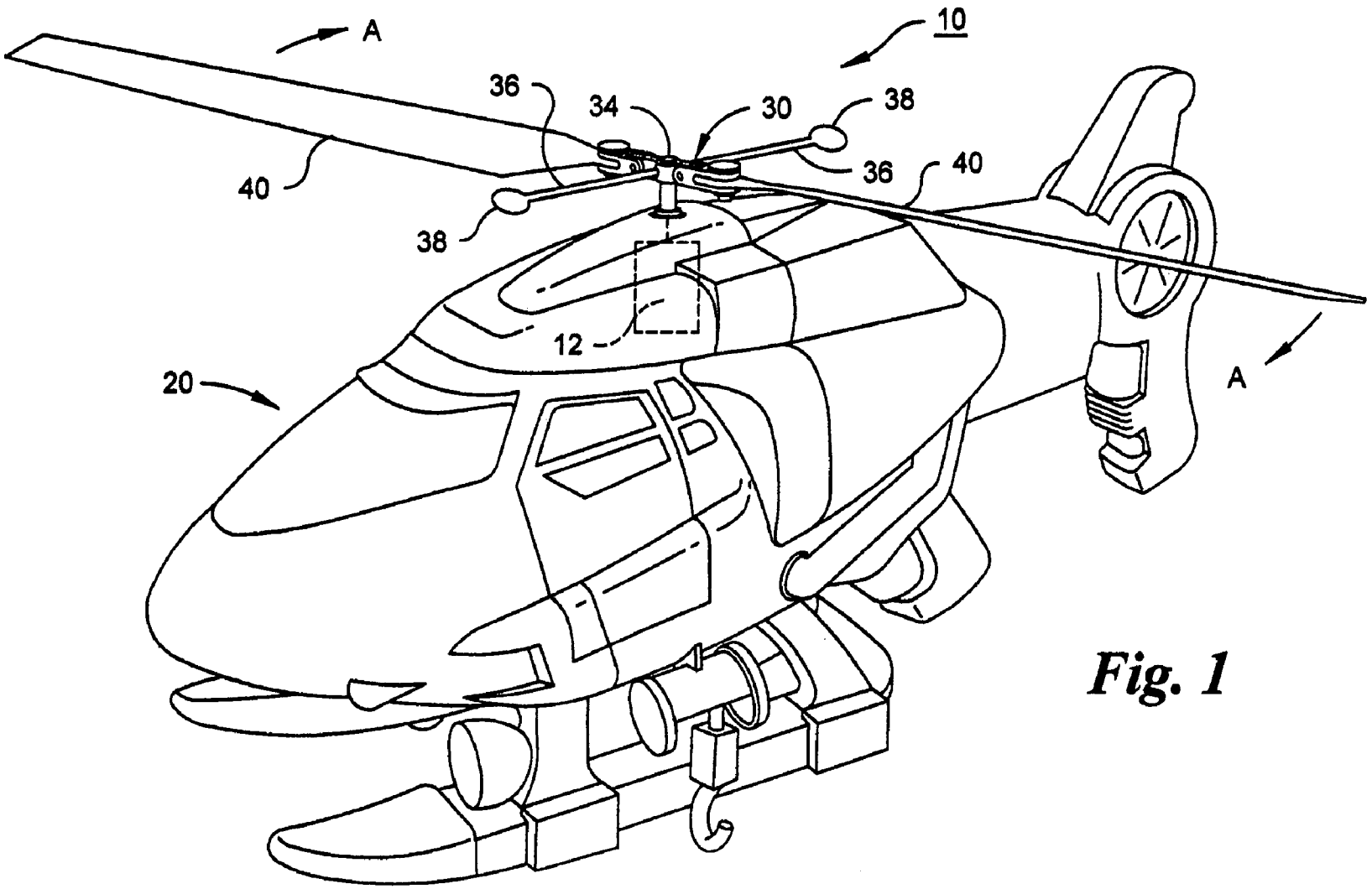
FIG. 1 is a top front perspective view of a vertical flying aircraft toy having a plurality of blades, each blade in accordance with a preferred embodiment of the present invention.

Certain terminology is used in the following description for convenience only and is not limiting. The words "right", "left", "upper", and "lower" designate directions in the drawings to which reference is made. The terminology includes the words above specifically mentioned, derivatives thereof, and words of similar import.

Referring to the drawings in detail, wherein like numerals indicate like elements throughout, there is shown in FIGS. 1–4 a preferred embodiment of an airfoil blade improvement having a cushioned leading edge for use with a toy aircraft toy in accordance with the present invention. Referring to FIG. 1, a powered toy aircraft 10 comprises a helicopter body 20 and a blade assembly 30. In addition to helicopter configurations, airplane and other aircraft configurations such as autogiro are possible. See, for example, U.S. Provisional Patent Application No. 60/443,720, which is incorporated by reference herein. The helicopter body 20 contains a preferably battery powered electric motor 12 (in phantom). The motor 12 is operably coupled with the blade assembly 30 to rotate the blade assembly 30. The artisan will recognize from this disclosure that a variety of different types of motors could be substituted for the battery-powered electric motor 12, for example a gasoline-powered motor, a gas turbine motor, a spring-driven motor, an elastic motor or a motor driven by pressurized fluid (including pressurized water or other pressurized liquid and pressurized air or other pressurized gas).

The blade assembly 30 of the preferred embodiment of the present invention has a plurality of blades 40. Although the embodiment shown has two blades 40, it is within the spirit and scope of the present invention to have a blade assembly 30 with more than two blades 40. The plurality of blades 40 extend radially outwardly from a center portion or hub 34. The blade assembly 30 rotatingly engages the motor 12 in the helicopter body 20 at the hub 34, such that the center of the hub 34 is the center of rotation of the blade assembly 30. The blade assembly 30 is intended to rotate in the direction of arrows A (FIG. 1). In the preferred embodiment illustrated, the blades 40 are pivotally mounted to the hub 34, allowing the blades 40 to pivot both rearwardly (in a direction opposite to the direction of arrows A in FIG. 1) and up and down with respect to the hub 34.

The blade assembly 30 may have a plurality of elongate weight arms 36 extending outwardly from and connected to the hub 34. Although the present embodiment shows two weight arms 36, it is within the spirit and scope of the present invention to have more than two and is preferable if there are more than two blades 32. Weights 38 may be situated at the ends of the weight arms 36 to provide greater rotational stability of the blade assembly 30 than a blade assembly 30 without such weights 38.

Figure 2:
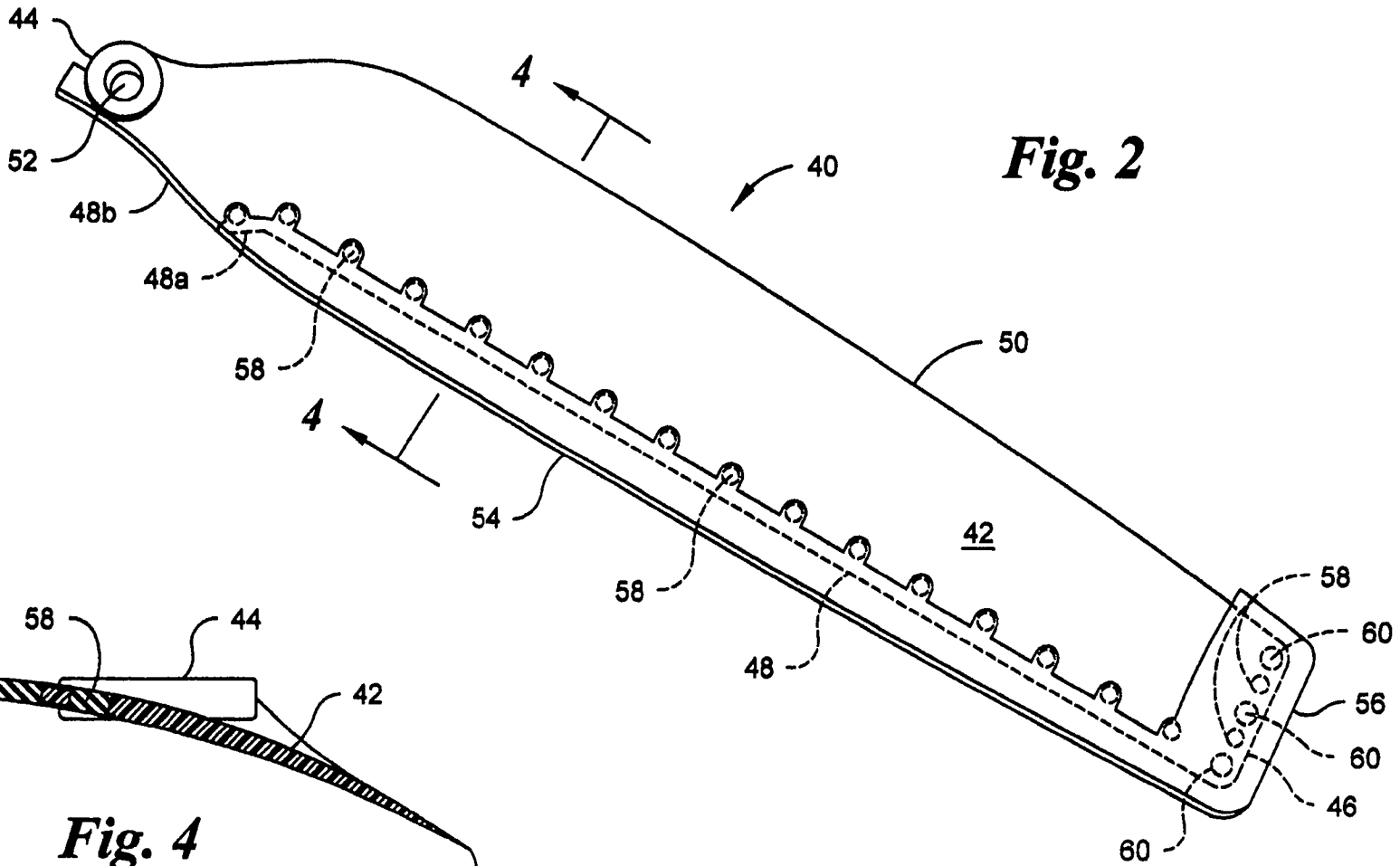
FIG. 2 is an upper perspective view of a blade of FIG. 1.
Figure 4:
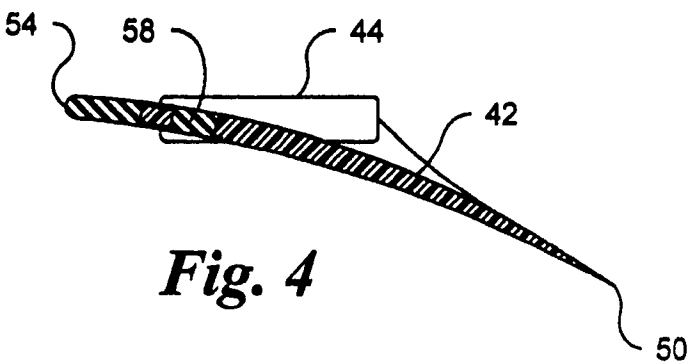
FIG. 4 is a cross-sectional view of the blade of FIG. 2 taken along line 4—4.
Figure 3:
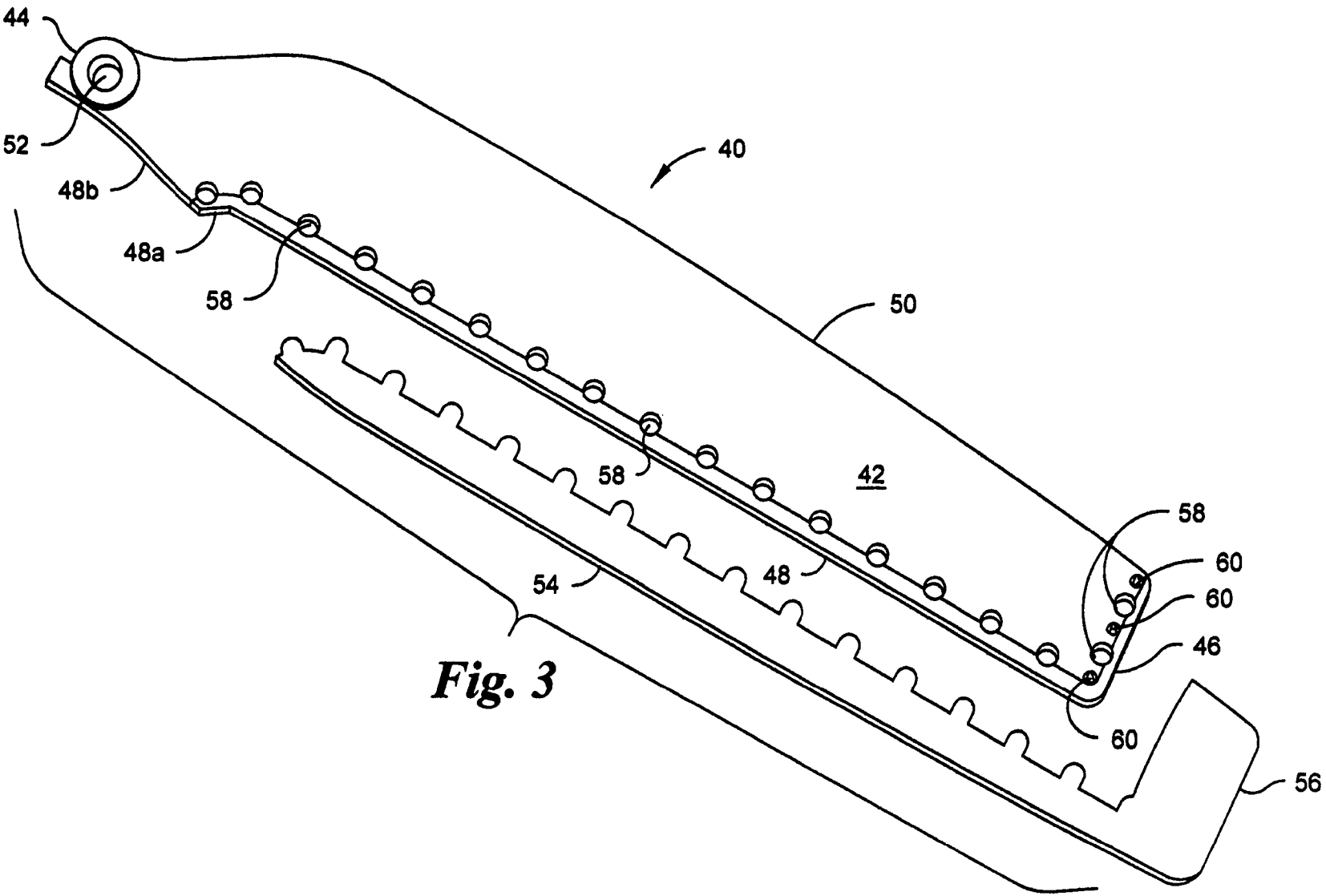
FIG. 3 is an exploded view of the blade of FIG. 1.

As illustrated in FIGS. 2–3, the blades 40 each comprise a body 42 having a first end 44 adjoining the hub 34, a second opposing end 46, a forward edge 48 and an opposing trailing edge 50. The first end 44 preferably includes an attachment hole 52 by which the blade 40 is attached to the hub 34. The artisan will recognize that the blade could be attached to the hub 34 in a variety of ways, including for example welding, adhesive, or a press fit with a mating receptacle or can be integrally formed in one piece with the hub 34 as with conventional wooden propellers. It is also within the spirit and scope of the present invention that the blade 40 be removably coupled with the hub 34 in a toy aircraft using screws, bolts, snaps, or the like. Each blade 40 is configured to generate lift when the blade assembly 30 is rotated in a "forward" direction (the direction of the arrows A) by the motor. More particularly, referring to FIG. 4, the body of each blade 40 is cambered between the forward edge 48 and the trailing edge 50 and has an effective propulsive airfoil profile.

The body 42 is preferably formed from a first polymeric material having a first rigidity which is preferably only flexibly resilient. The first polymeric material is preferably a polypropylene, and the body 42 is fabricated using injection molding techniques well known in the art. Preferably, the polypropylene is a FINA 4660G copolymer.

A second material is disposed along and forward of the forward edge 48 of the body 42 to form a cushioned leading edge 54 of the blade 40. Preferably, the forward edge 48 has a first portion 48*a* and a second portion 48*b* with the first portion 48*a* notched rearwardly toward the trailing edge 50 from the second portion 48*b*. The second material engages with the first portion 48*a* and preferably extends forwardly from the first portion 48*a* so as to align with the second portion 48*b* and form the cushioned leading edge 54 of the airfoil blade 40. Alternatively, the forward edge could be straight and the second material extend forward of the forward edge to form the leading edge of the body 40. The second material is preferably also disposed along the second end 46 of the body 42 to form a cushioned tip 56 of the blade 40.

The second material has a second rigidity which is lower than the first rigidity such that the cushioned edge 54 is comparatively softer and more pliable as compared to the body 42. Preferably, the second material is a polymer from the class of materials known as thermoplastic elastomers, for example styrenic block copolymers such as a Shore A 45° C. elastomer.

The cushioned edge 54 and cushioned tip 56 are preferably attached to the body 42 using a mechanical connection. Multiple openings 58 are disposed in the body 42 proximate the forward edge 48. Additionally, multiple protrusions 60 are disposed on the body 42, preferably proximate the second opposing end 46, although it is within the spirit and scope of the present invention that the protrusions 60 be located along at least a portion of the first edge 48. During an injection molding manufacturing process, the second material flows within at least a plurality of the openings 58 and molds around at least a plurality of the protrusions 60 to mechanically attach the cushioned edge 54 and cushioned tip 56 to the body 42. It is preferable that at least some of the plurality of openings 58 extend entirely through the body 42 so that the second material forms a solid connection through the body 42 along the forward edge 48.

From the foregoing it can be seen that the present invention comprises an improved airfoil blade suitable for use with a toy aircraft, having a cushioned leading edge and, preferably, a cushioned outer tip. This construction meets toy standards in the United States and Europe.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. In a powered toy aircraft, an airfoil blade improvement comprising:

a body having a first end adjoining a hub, a second opposing end, a forward edge, and an opposing trailing edge; and a cushioned edge attached to the body extending at least along the forward edge so as to form a leading edge of the blade;

wherein:

the body is formed from a first polymeric material having a first rigidity and the cushioned edge is formed from a second material having a second rigidity lower than the first rigidity;

the body further includes multiple openings disposed proximate the forward edge;

the second material fills at least a plurality of the openings to form a mechanical connection between the cushioned edge and the body, and at least some of the plurality of openings extend entirely through the body.

2. The improvement of claim 1, wherein the blade is pivotally coupled with the hub.

3. The improvement of claim 1, wherein the blade is removably coupled with the hub.

4. The improvement of claim 1, wherein the first polymeric material is a polypropylene.

5. The improvement of claim 1, wherein the second material is polymeric.

6. The improvement of claim 1, wherein the second material is elastomeric.

7. The improvement of claim 6, wherein the first polymeric material is a polypropylene.

8. The improvement of claim 1, wherein the body is cambered between the leading edge and the trailing edge.

9. The improvement of claim 1, wherein a first portion of the forward edge extends rearwardly toward the trailing edge from a second portion of the forward edge, and wherein the second material is engaged with the first portion and extends forwardly from the first portion so as to align with the second portion.

10. In a powered toy aircraft, an airfoil blade improvement comprising:

a body having a first end adjoining a hub, a second opposing end, a forward edge, and an opposing trailing edge; and a cushioned edge attached to the body extending at least along the forward edge so as to form a leading edge of the blade;

wherein:

the body is formed from a first polymeric material having a first rigidity and the cushioned edge is formed from a second material having a second rigidity lower than the first rigidity;

the body further includes multiple protrusions; and the second material molds around at least a plurality of the protrusions to form a mechanical connection between the cushioned edge and the body.

11. The improvement of claim 10, wherein the plurality of protrusions are located proximal the second opposing end of the body, whereby the second material forms a cushioned tip at the second opposing end of the body.

12. In a powered toy aircraft, an airfoil blade improvement comprising:

a body having a first end adjoining a hub, a second opposing end, a forward edge, and an opposing trailing edge; and a cushioned edge attached to the body extending at least along the second opposing end so as to form a cushioned tip of the blade;

wherein:

the body is formed from a first polymeric material having a first rigidity and the cushioned edge is formed from a second material having a second rigidity lower than the first rigidity;

the body further includes multiple openings;

the second material fills at least a plurality of the openings to form a mechanical connection between the cushioned edge and the body, and at least some of the plurality of openings extend entirely through the body.

13. In a powered toy aircraft, an airfoil blade improvement comprising:

a body having a first end adjoining a hub, a second opposing end, a forward edge, and an opposing trailing edge; and a cushioned edge attached to the body extending at least along the second opposing end so as to form a cushioned tip of the blade;

wherein:

the body is formed from a first polymeric material having a first rigidity and the cushioned edge is formed from a second material having a second rigidity lower than the first rigidity;

the body further includes multiple protrusions; and the second material molds around at least a plurality of the protrusions to form a mechanical connection between the cushioned edge and the body.

14. The improvement of claim 13, wherein the plurality of protrusions are proximal the second opposing end of the body.

15. The improvement of claim 13, wherein the blade is pivotally coupled with the hub.

16. The improvement of claim 13, wherein the blade is removably coupled with the hub.

17. The improvement of claim 13, wherein the first polymeric material is a polypropylene.

18. The improvement of claim 13, wherein the second material is polymeric.

19. The improvement of claim 13, wherein the second material is elastomeric.

20. The improvement of claim 19, wherein the first polymeric material is a polypropylene.

21. The improvement of claim 13, wherein the body is cambered between the forward edge and the trailing edge.

22. The improvement of claim 13, wherein a first portion of the forward edge extends rearwardly toward the trailing edge from a second portion of the forward edge, wherein the second material is engaged with the first portion and extends forwardly from the first portion so as to align with the second portion.

* * * * *